US005465427A

United States Patent [19]

Shields

[11] Patent Number: 5,465,427

[45] Date of Patent: Nov. 14, 1995

[54] FACIAL MASK AND METHOD

[75] Inventor: Rodney M. Shields, Danville, Calif.

[73] Assignee: Creative Minds Foundation, Wilmington, Del.

[21] Appl. No.: 188,670

[22] Filed: Jan. 27, 1994

[51] Int. Cl.[6] ..... A42B 1/00

[52] U.S. Cl. ..... 2/206; 2/173

[58] Field of Search ..... 2/9, 173, 206, 2/424, 171; 128/202.22, 205.23, 205.27, 205.28, 205.29, 206.19, 857, 863; 602/74; 604/303; D21/190

[56] References Cited

U.S. PATENT DOCUMENTS

| | | | |
|---|---|---|---|
| 1,655,440 | 1/1928 | Soble | 2/173 |
| 2,124,767 | 7/1938 | Dawn | 2/206 |
| 2,262,992 | 11/1941 | Dessart | 2/206 |
| 2,355,283 | 8/1944 | Diss | 2/173 |
| 2,964,757 | 12/1960 | Jarvis | 2/173 |

*Primary Examiner*—Diana Biefeld

*Attorney, Agent, or Firm*—Thomas C. Feix; John L. McGannon

[57] ABSTRACT

A mask body of semi-rigid material having a plurality of holes through the body which permit visibility and breathability. The inner surface of the mask body is of a dark color so as not to impair the vision of the wearer. The outer surface of the mask is preferably painted with a desired image or a solid color. The holes can be made in the body before or after the body forming process. The mask can be covered with different materials for different visual and textural effects. For example, the mask could be partially or fully covered with hair, fur, fabric, appendages, paint or other finishes. The mask could be reversible if desired, and it could have a rotatable mask body on the whole head and the head can be rotatable on the head or have spinning effects on the head or other desired effects.

16 Claims, 6 Drawing Sheets

FACIAL MASK AND METHOD

This invention relates to improvements in facial masks and to a method of making such a mask. More particularly, the invention relates to a mask which is universally fitted to human faces of different sizes and shapes.

BACKGROUND OF THE INVENTION

In using Halloween-type masks, it is desirable to achieve two different and often contrary purposes. First, the mask must serve as a disguise for the wearer, and secondly, the wearer must be able to see properly through the mask and to breathe normally when wearing the mask. With traditional masks, these requirements result in trade-offs in which large eye holes and nostril openings are required where much of face of the wearer can be seen.

Traditional Halloween masks with eye holes can also have great visibility problems due to the differences in eye spacing of different wearers. For example, the eyes of a three year old child would not necessarily line up with those of an adult. Furthermore, traditional masks have a tendency to slip along the face, causing a misalignment between the eyes in the mask and the eyes of the wearer. This can create safety problems when the wearer cannot see properly, many children having been injured on Halloween night because of such a defect. They have not been able to see well as they move around in dark and sometimes unfamiliar territory.

Traditional masks also do not allow a wearer to breathe well. Generally, these masks are made of an impervious plastic or rubber material. The moisture in the breath of the wearer as well as the wearer's perspiration are trapped inside the mask and condense on the inner surface of the mask. This can become uncomfortable to the wearer.

Because of the foregoing drawbacks of conventional masks, a need has continued to exist for improvements in facial masks, and the present invention satisfies such a need.

SUMMARY OF THE INVENTION

The mask of the present invention is directed to a mask body which is of a semi-rigid material having a plurality of perforations or holes through the body which permit both good visibility and breathability. The interior surface of the mask has a uniformly dark color, at least around the eye areas, so as not to impair the vision of the wearer. The outside surface of the mask is preferably painted with a desired image or a solid color.

The present invention is also adapted for other types of masks such as those used for cold weather or skiing. Such masks could be semi-rigid or they could be flexible. Furthermore, they could be decorated with paint or other materials to create caricatures of mascots or other characters.

The use of a perforated mask body without having large eye holes or mouth holes in the body permit the image on the outside surface to achieve effects not possible with traditional masks. These feature may include having glow-in-the-dark eyes, having eyes that are on different locations on the face, or having no eyes at all. The mask of the present invention is, therefore, comprised of a panel or series of panels with a pattern of holes therethrough and with the panels being formed in the shape of a facial mask.

The holes can be made in the body either before or after the body forming process. The forming process can be any one of several different methods, such as thermoforming, vacuum molding, and the like. In the case of vacuum molding, pre-perforated body material or a suitable non-perforated backing material can be used so that a vacuum can be created. This backing could be a flexible membrane that is used over and over again, or could be a thermoformable plastic that is either discarded or can remain on the product and can be used for the packaging of the Halloween mask of a blister pack.

The body of the mask can be a single panel which is of a dark inner material or which is colored or painted on the outer surface. This is chosen so that the vision of the wearer is not impaired by light reflections on the inner surface of the mask. Other configurations include mask bodies having multiple panels bonded, laminated, or coextruded together and which have dark-colored surfaces on the inner surfaces, and mask bodies with the desired structural and visual properties which make up sandwiched panels. The construction can be of any number of stacked panels which are perforated and formed into the shape of a mask, or shaped into a mask and then perforated.

The mask can be covered with different materials for different visual and textural effects. For example, the mask could be partially or fully covered with hair, fur, fabric, appendages such as decorative objects or physical objects, paint or other finishes, or combinations of these. A thin, lightweight fabric could be used to obscure the holes and yet permit breathability and vision through both the perforations and the fabric body. A fabric such as this could be printed, colored or dyed as desired.

The mask could be reversible if desired, and it could have a rotatable mask body on the whole head and the head can be rotatable on the head or have spinning effects on the head or other desired effects.

The primary object of the present invention is to provide an improved facial mask and method of making such a mask wherein the mask has a perforated body provided with a plurality of holes therethrough and the body preferably has a dark inner surface of the mask so that the eyes of the wearer can be focused through the mask on the region exteriorly of the mask, yet the front of the mask can be painted or applied with specific designs and caricatures as desired with the ultimate end being that the mask will provide enjoyment to the wearer and provides also an adequate disguise which conceals the identity of the wearer as well as to provide adequate forward and side vision without the need for large eye holes, mouth holes and nose holes.

Other objects of this invention will become apparent as the following specification progresses, reference being had to the accompanying drawings for an illustration of several embodiments of the mask of the present invention.

DESCRIPTION OF THE SPECIFIC EMBODIMENTS

Figure 1:
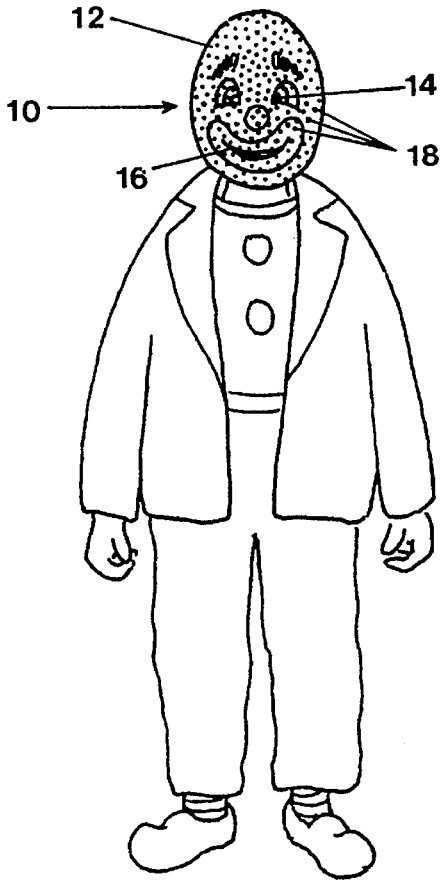
FIG. 1 is a front elevational view of a first embodiment of a mask on a child.

The first embodiment of the mask of the present invention is denoted by the numeral 10 and is shown in FIG. 1. Mask 10 includes a sheet 12 of material, such as a suitable plastic formed to fit a human face. The mask can have simulated eye holes 14 and a simulated mouth hole 16 which defines a facial image and which are applied by colored material to the front face of sheet 12. The mask also has a plurality of small holes 18 therethrough. There may be as many as 100 to 1,000 or more small holes 18 per square inch of space of a mask 10. Some suitable means may be provided, such as a flexible, elastic strap, hood, hat, wig or the like for removably holding the mask on the face of the wearer. These parts could make up a complete costume. The attachment of appendages such as fur, hair, fabric and the like could be provided in kit form, if desired. The mask can be made to be rotated or otherwise spin about an axis, such as a vertical axis. A slitted panel in which the slits expand into the holes could occur during a forming process. The present invention also contemplates a forming method that uses a flexible, reusable membrane in the vacuum forming process.

Figure 1A:
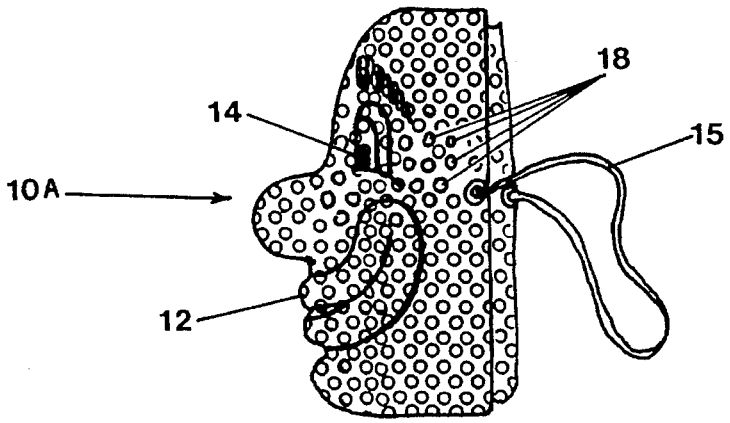
FIG. 1A is a side elevational view of a second embodiment showing the holes in the mask and the strap for attaching the mask to the face of the wearer.

FIG. 1A shows another embodiment of the mask is denoted by the numeral 10*a*. The mask has a pair of simulated eye holes 11 and a simulated mouth hole 12 as well as a strap 15 for attaching the mask to the head of the wearer.

Figure 2:
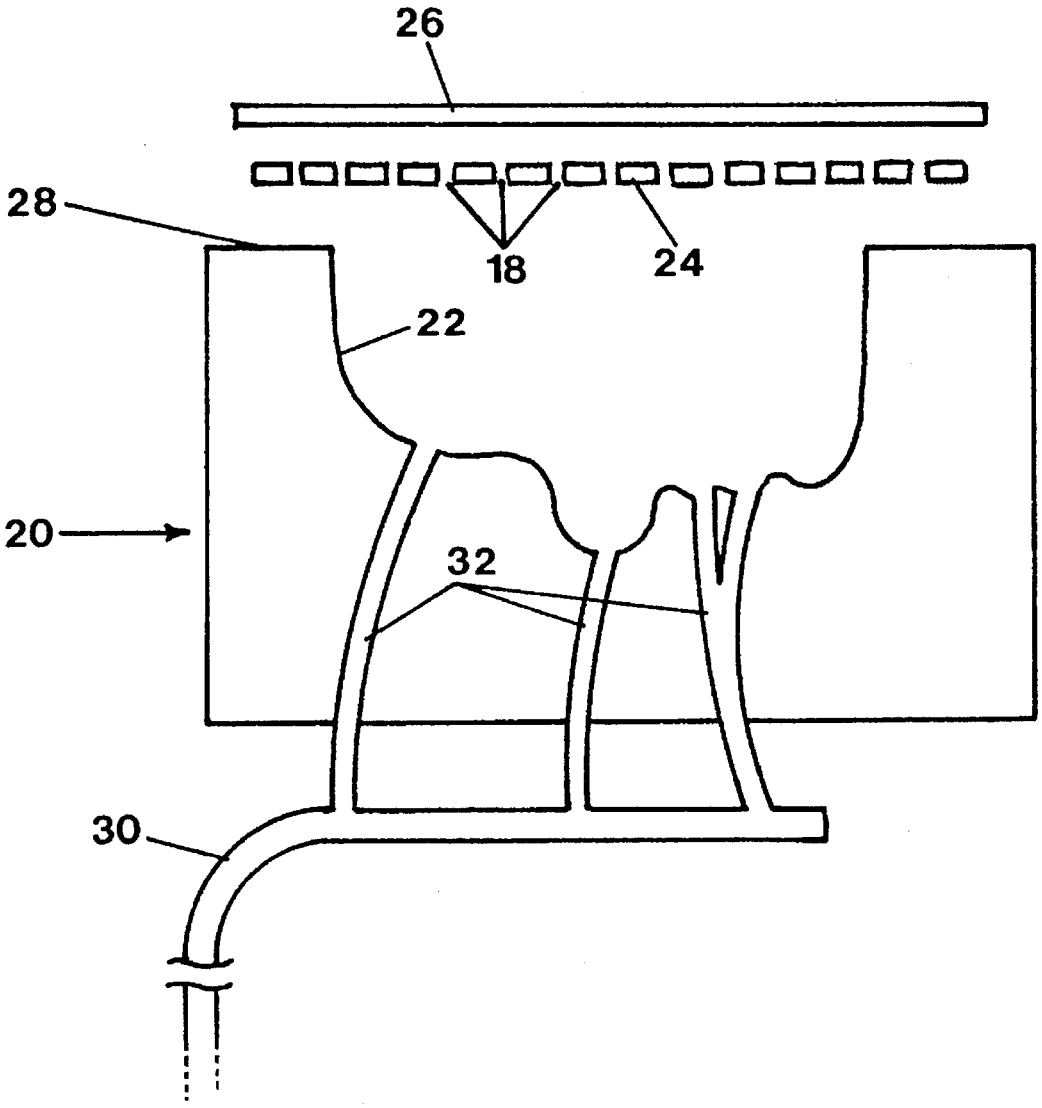
FIG. 2 is a female mold for forming the mask of FIGS. 1 and 1A.

The mask can be made in accordance with the use of a female mold as shown in FIG. 2. The mold 20 has a recess 22 for receiving a sheet 24 which is a perforated panel. An impervious sheet 26 is used as a backing for sheet 24 when the same is applied to the upper surface 28 of the mold. When so placed in engagement with surface 28, the sheet 24 is drawn by suction into the recess 22 and heat formed when a vacuum is applied to tube 30 connected by tubes 32 to recess 22. The molding process requires a certain molding time. As soon as the molding has been completed, the backing plate 26 is removed and the mask can be removed ready for use or ready to receive an image on the front face thereof.

Figure 3:
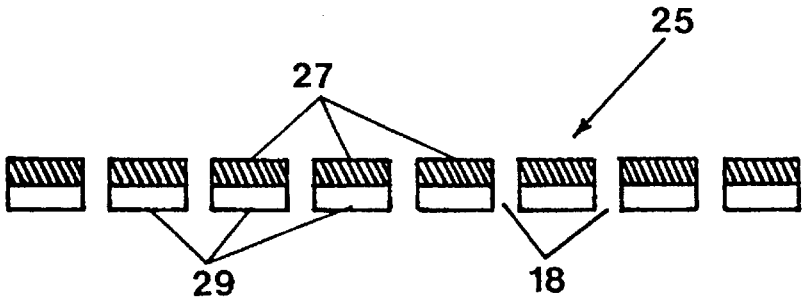
FIG. 3 is an enlarged, cross-sectional view of mask material showing the holes in the mask body and the colored material on which an image can be placed.
Figure 4:
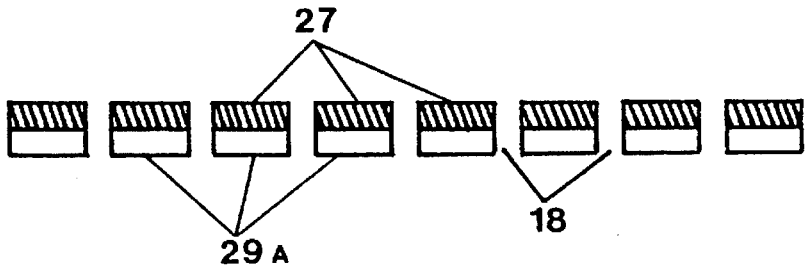
FIG. 4 is a view similar to FIG. 3 but showing a pre-printed image on the dark backing material.

FIG. 3 shows a sheet of perforated panel material denoted by the numeral 25. It includes a black surface 27 and a white surface 29. The black surface 27 will face upwardly in the recess 22 and it will form the inside surface of the mask. Surface 29 will be typically white and will receive a design, such as lines of a particular design, as well as images of eye and mouth holes. FIG. 4 is a view similar to FIG. 3 but showing a pre-applied color coating 29*a* secured to the front face of surface 27.

Figure 5:
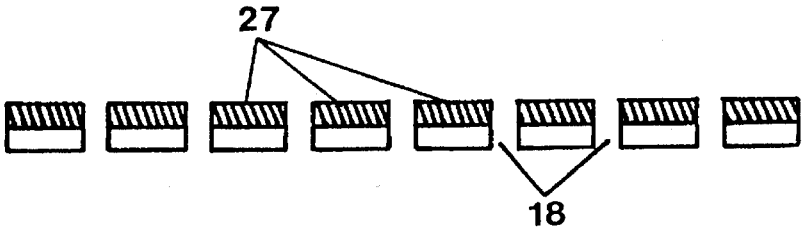
FIGS. 5 and 6 are views similar to FIGS. 3 and 4 but showing other coatings, all of which are provided for placement in the mold of FIG. 2.
Figure 6:
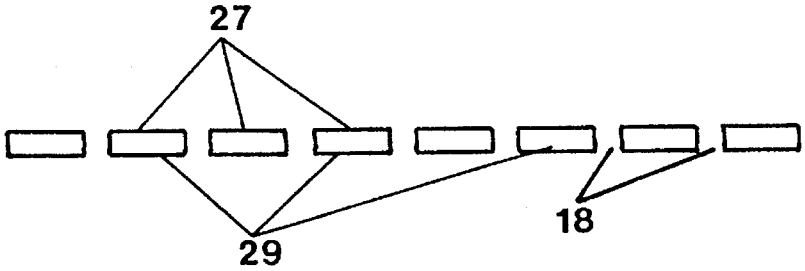
Figure 7:
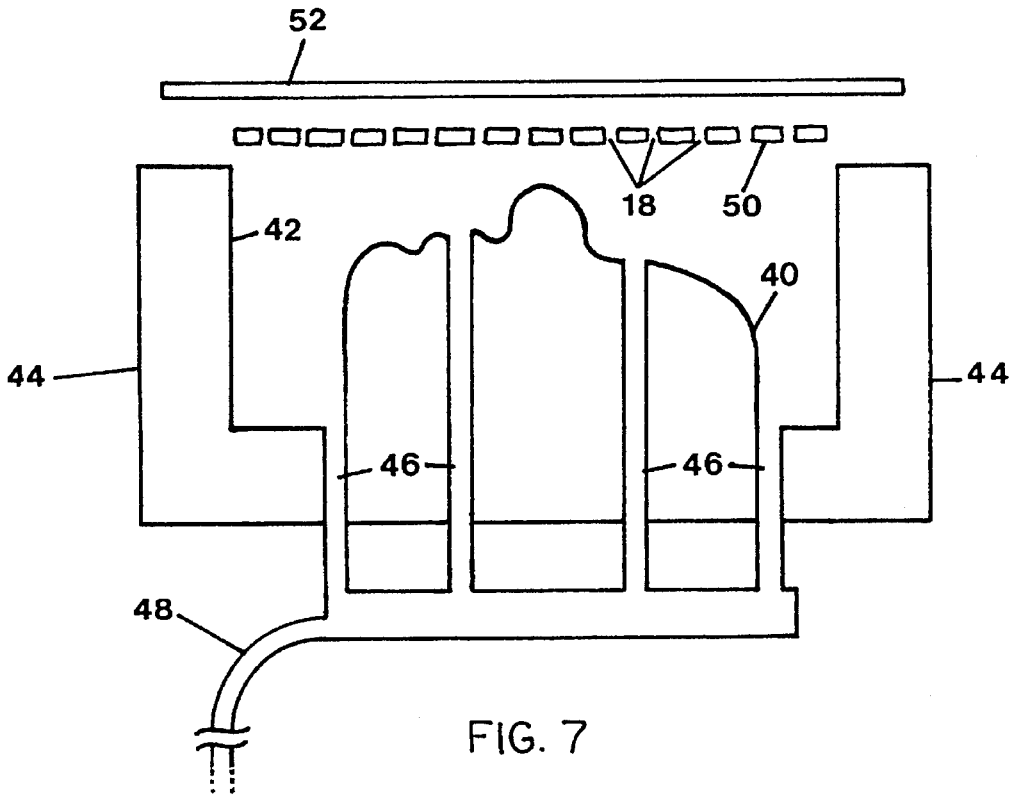
FIGS. 7–10 illustrate several steps in the formation of a mask with a male mold.

FIGS. 5 and 6 show that a very thin dark or black coating 27 and dark no coating 27, respectively, can be provided along with white coating material for economy purposes. The solid color material will typically be colored as needed on the exterior surface and be dark on the inside surface of the mask.

Figure 8:
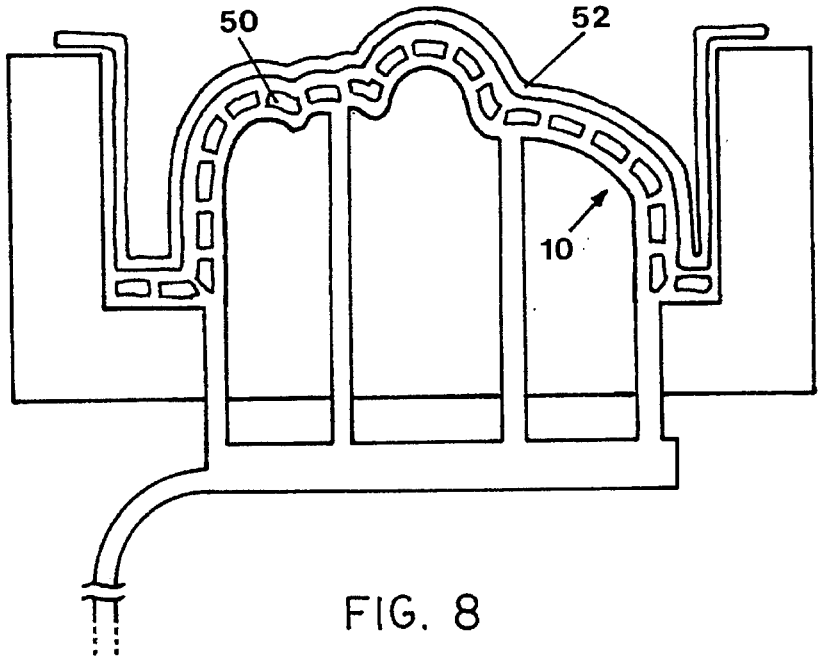
Figure 9:
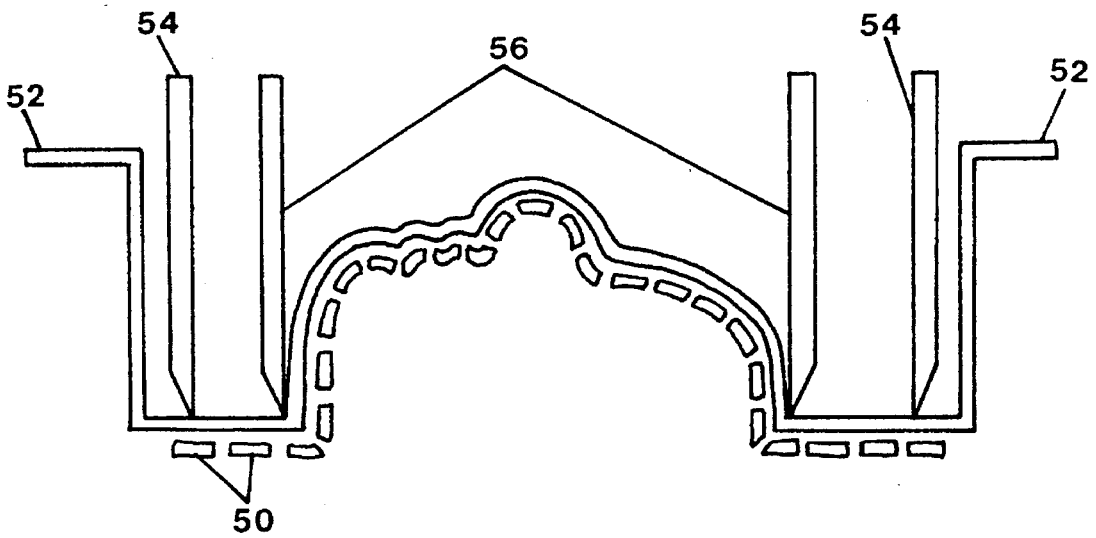

FIGS. 7–10 show various steps in the formation of a mask using a male mold. The male mold 40 is in a recess 42 of a mold body 44. Passages 46 couple recess 42 to a vacuum tube 48 so that when a vacuum is pulled, the perforated panel 50 is drawn down over the male mold 40 as shown in FIG. 8 and heat is applied to thermoform the mask identified by the numeral 10. Since the clear backing sheet 52 is flexible, it will follow the contours of the male mold as shown in FIG. 8. The resulting mask 10 has the cross section of FIG. 3, and cutting tools 54 and 56 can be used to trim the excess plastic material off the mask, thereby resulting in mask 10 of FIG. 10. Heat can be applied either before or after the application of the vacuum.

The clear plastic backing sheet may be used to package the resulting mask 14 with a blister package. A flange 60 is left on sheet 52 as shown in FIG. 10A, and this flange 60 is bonded to a cardboard backing with the mask in the package.

Figure 10:
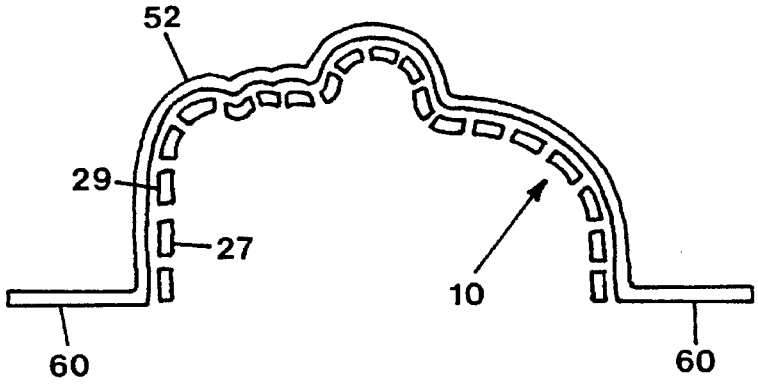
Figure 10A:
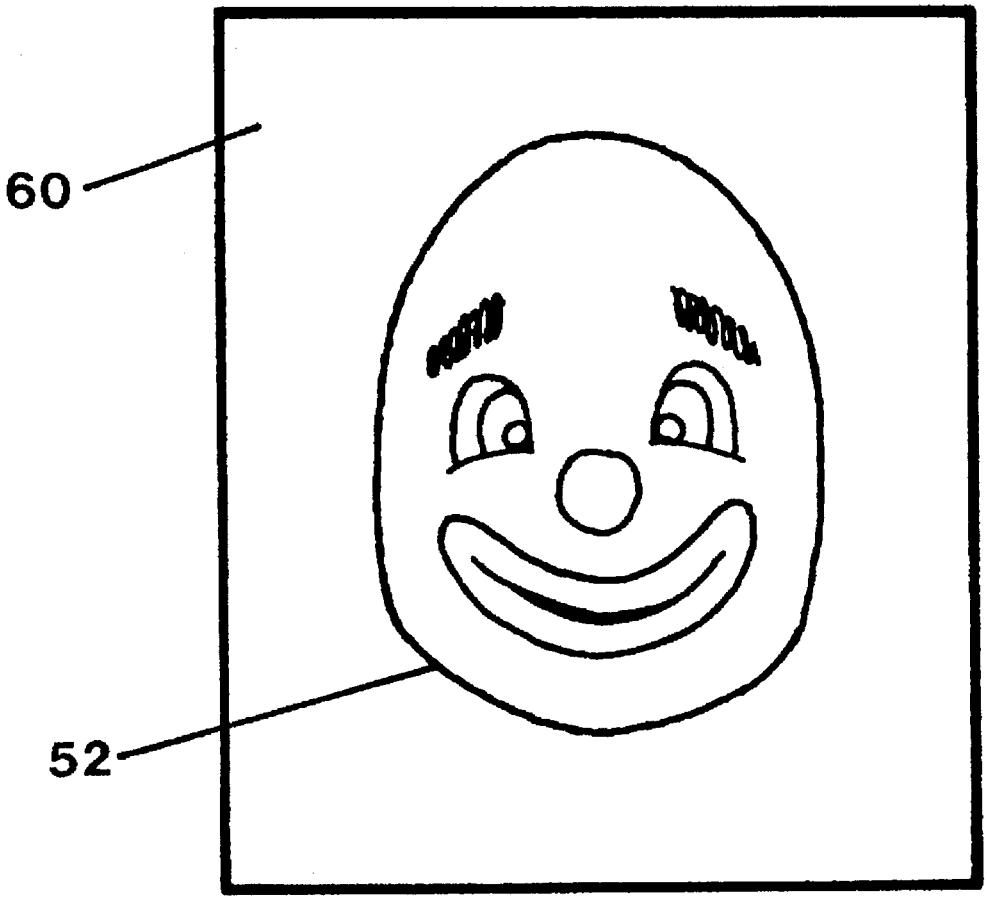
FIG. 10A shows the mask in a blister pack.

It can be seen in FIG. 10 that the mask is normally comprised of an outer white surface 29 and an inner perforated dark surface 27. The mask can be worn and the black surface will face against the facial features of the wearer while the white surface will face forwardly and can be applied with an image if desired.

The present invention also contemplates a facial mask in which the body of the mask is slit before the forming process so that the elongation of the panel that occurs during the forming process opens up the slits in much the same manner that metal is expanded into expanded metal mesh. With the use of slitting in a horizontal pattern and the elongation at sides of the mask largely in the direction of the slits, the slits on the sides of the mask tend not to open as much as on other areas of the mask and the sides of the mask would remain more solid than the front of the mask and this may give a better appearance from the profile of the mask.

What is claimed is:

1. A facial mask comprising:

a) a sheet of formable material which is formed as a mask body sized to fit over a human face, said mask body including:

i) an inner surface for engaging a face of a wearer, said inner surface being of a dark color for absorbing light;

ii) an outer surface provided with a light color coating; and b) a pattern of through-holes disposed in said mask body, said through-holes being sized sufficiently small in diameter and having a sufficiently tight pattern spacing to permit substantially unobstructed vision through the mask body by a wearer and at the same time substantially prevent vision into the mask body by an observer outside the mask body.

2. A facial mask as set forth in claim 1, wherein said sheet of formable material comprises thermoformable plastic.

3. A facial mask as set forth in claim 1, wherein said light color coating contains a decorative image.

4. A facial mask as set forth in claim 1, wherein the pattern of through-holes are evenly spaced in a range of between 100–1000 through-holes per square inch of surface area of the mask body.

5. A facial mask as set forth in claim 1, wherein the mask body has at least one appendage for decorating the mask body.

6. A facial mask as set forth in claim 1, wherein the mask body is provided with means for attaching the mask body to the head of a wearer.

7. A facial mask as set forth in claim 6, wherein the attaching means includes an appendage taken from the group consisting of hair, wigs, hoods and hats.

8. A facial mask as set forth in claim 1, wherein the through-holes define an open area in a range of 40–75% of an entire area of the mask body.

9. A facial mask comprising:

a) a first sheet of formable material of a dark, light-absorbing color;

b) a second sheet of formable material of a light color;

c) said first and second sheets being arranged in stacked fashion and formed together as a mask body sized to fit over a human face wherein:

i) said first sheet defines an inner surface of said mask body for engaging a face of a wearer; and ii) said second sheet defines an outer surface of said mask body; and d) said first and second sheets including a pattern of through-holes, said through-holes being sized sufficiently small in diameter and having a sufficiently tight pattern spacing to permit substantially unobstructed vision through the mask body by a wearer and at the same time substantially prevent vision into the mask body by an observer outside the mask body.

10. A facial mask as set forth in claim 9, wherein said first and second sheets of formable material comprise thermoformable plastic.

11. A facial mask as set forth in claim 9, wherein said second sheet contains a decorative image.

12. A facial mask as set forth in claim 9, wherein the pattern of through-holes are evenly spaced in a range of between 100–1000 through-holes per square inch of surface area of the mask body.

13. A facial mask as set forth in claim 9, wherein the mask body has at least one appendage for decorating the mask body.

14. A facial mask as set forth in claim 9, wherein the mask body is provided with means for attaching the mask body to the head of a wearer.

15. A facial mask as set forth in claim 14, wherein the attaching means includes an appendage taken from the group consisting of hair, wigs, hoods and hats.

16. A facial mask as set forth in claim 9, wherein the through-holes define an open area in a range of 40–75% of an entire area of the mask body.

* * * * *